US005604486A

United States Patent [19]

Lauro et al.

[11] Patent Number: 5,604,486

[45] **Date of Patent: *Feb. 18, 1997**

[54] RF TAGGING SYSTEM WITH MULTIPLE DECODING MODALITIES

[75] Inventors: George L. Lauro, Lake Zurich; Sanjar Ghaem, Palatine; Rudyard L. Istvan, Winnetka, all of Ill.

[73] Assignee: Motorola, Inc., Schaumburg, Ill.

[ * ] Notice: The term of this patent shall not extend beyond the expiration date of Pat. No. 5,473,330.

[21] Appl. No.: 67,923

[22] Filed: May 27, 1993

[51] Int. Cl.[6] ..... G08B 13/14

[52] U.S. Cl. ..... 340/572; 340/539; 340/825.44; 340/825.54; 340/825.3; 340/505

[58] Field of Search ..... 340/572, 825.54, 340/505, 825.3, 825.44, 539; 235/383, 385; 342/42, 51

[56] References Cited

U.S. PATENT DOCUMENTS

| | | | |
|---|---|---|---|
| 3,671,721 | 6/1972 | Hunn et al. | 235/61.1 |
| 4,023,167 | 5/1977 | Wahlstrom | 343/6.5 |
| 4,114,140 | 9/1978 | Kubina | 340/825.3 |
| 4,679,154 | 7/1987 | Blanford | 235/383 |
| 4,940,116 | 7/1990 | O'Connor | 235/383 |
| 4,959,530 | 9/1990 | O'Connor | 235/383 |
| 5,036,308 | 7/1991 | Fockens | 340/572 |
| 5,119,070 | 6/1992 | Matsumoto et al. | 340/572 |
| 5,151,684 | 9/1992 | Johnsen | 340/572 |
| 5,179,270 | 1/1993 | Taussig | 235/383 |
| 5,237,620 | 8/1993 | Deaton | 235/383 |
| 5,239,167 | 8/1993 | Kipp | 235/383 |
| 5,393,965 | 2/1995 | Bravman | 235/383 |

FOREIGN PATENT DOCUMENTS

| | | |
|---|---|---|
| WO86/02186 | 4/1986 | WIPO . |
| WO86/04172 | 7/1986 | WIPO . |

*Primary Examiner*—Jeffery Hofsass
*Assistant Examiner*—Albert K. Wong
*Attorney, Agent, or Firm*—Phillip H. Melamed

[57] ABSTRACT

An RF tagging system includes an RF tag (10, 30) and an RF tag reader 80. The RF tag includes a plurality of RF resonant circuits. Each RF resonant circuit is resonant at a given RF frequency. A group of decoder RF resonant circuits (12, 32) have resonant frequencies defining one of a plurality of predetermined decoding modalities. A group of data RF resonant circuits (14, 34) have resonant frequencies corresponding to a predetermined identification code when the resonant frequencies of the data RF resonant circuits are decoded in accordance with the one decoding modality. The RF tag reader detects the resonant frequencies of the decoder RF resonant circuits and determines the one decoding modality. The RF tag reader is operative in each of the plurality of predetermined decoding modalities, detects the resonant frequencies of the group of data RF resonant circuits, and decodes the resonant frequencies of the group of data RF resonant circuits in accordance with the one decoding modality to provide the identification code. The decoder RF resonant circuits may also indicate the number of data RF resonant circuits on the RF tag. The RF tag reader determines the predetermined number from the decoder RF resonant circuits to confirm the accurate detection of the data RF resonant circuits. The RF tag reader, when selecting a decoding modality in accordance with the detected resonant frequencies of the decoder RF resonant circuits, determines various frequency bands and alters the RF tag reader frequency detection operation for accurate detection of the data RF resonant circuits.

1 Claim, 3 Drawing Sheets

RF TAGGING SYSTEM WITH MULTIPLE DECODING MODALITIES

FIELD OF INVENTION

The present invention generally relates to the field of RF tagging systems in which the presence of resonant circuits on a tag are detected to generate a code determined in accordance with which resonant circuits are being detected. The present invention is more particularly directed to an RF tagging system which includes an RF tag reader operable in a plurality of different decoding modalities which is responsive to decoder RF resonant circuits on a tag for operating in a designated one of the decoding modalities to generate the code. The RF tag reader first detects the resonant frequencies of the decoder RF resonant circuits to determine the designated decoding modality. Thereafter, the RF reader detects the resonant frequencies of a plurality of data RF resonant circuits and then determines the code in accordance with the designated modality. Further, the decoder RF resonant circuits may designate the number of data RF resonant circuits to permit the RF tag reader to verify accurate detection of the data RF resonant circuits. In addition, the RF tag reader may be operative in a calibration mode rendered operable by the decoder RF resonant circuits to compensate for frequency shifts of the resonant frequencies of the data RF resonant circuits due to the interaction of the tagged item with the data RF resonant circuits on the RF tags. More specifically, in the calibration mode, the RF tag reader compensates for spatial and/or frequency dependent resonant frequency shifts in the resonant frequencies of the data RF resonant circuits due to interaction between the tagged item and the data RF resonant circuits on the tag.

BACKGROUND OF THE INVENTION

Prior art systems are known in which the existence of a single resonant circuit in a detection field or zone is utilized as an anti-theft type apparatus. Essentially, if an article having a single resonant frequency tag passes through a detection zone, an alarm is generated which indicates the unauthorized presence of store goods in the detection zone. Such resonant circuits have been constructed in accordance with standard printed circuit board techniques.

Some prior RF tagging systems have provided multiple different tuned (resonant) circuits on a tag so as to specifically identify the goods to which the tag is attached or the destination to which those goods should be directed. Such systems have been proposed for parcel or other article delivery systems wherein resonant circuits are utilized to provide a destination or sender code rather than printed bar codes.

The use of resonant circuit tagging is advantageous in that it is not subject to problems such as dirt obscuring a portion of a printed bar code and causing an error in determining the code associated with the article. Also, exact alignment of the tag with the detection system may not be required in RF tagging systems, since generally it is desired only to detect the presence of the resonant circuits somewhere in a broad detection zone. This can be achieved without precise alignment between the resonant circuit, the detection zone and the detection apparatus. However, prior systems utilizing multiple tuned circuit detection contemplate sequentially generating or gating each of the different resonant frequency signals to a transmitter antenna, and then waiting for reflected energy from each of the tuned circuits to be detected. Some frequency tagging systems look for absorption of RF energy by a resonant circuit during the transmission of each test frequency signal.

Generally, each different resonant frequency in a multiple frequency system is provided by a master oscillator circuit or transmitter whose output is essentially swept or stepped to sequentially provide each desired output frequency. In all of these systems the result is essentially a slow detection system since the systems sequentially radiate each of the different frequencies. Rapid detection is achieved only if there are a few different frequencies involved.

Some prior RF tagging systems contemplate printing a large number of different resonant frequency circuits on a tag and then creating different codes by the selective adjustment of some of these resonant circuits. These systems have recognized that it may be necessary to adjust the resonant frequency provided for each circuit and such adjustment is generally contemplated as occurring by selective removal of metalization forming the resonant circuit. Some systems have recognized that step adjustments of the resonant frequency of such tuned circuits is desirable and this has been implemented by punching holes of predetermined diameters in capacitive elements of the resonant circuit to thereby reduce capacitance and increase the frequency of the resonant circuit. Such known prior techniques are not readily adaptable to mass production of customized resonant frequency codes by a post factory manufacturing operation. Many times, the actual code to be utilized will not be known until immediately prior to attaching a tag or label to an article.

When it is possible to accurately control the orientation between the resonant multiple frequency tag and the detection zone, some prior systems have noted that fewer different resonant frequencies may be needed to produce the desired end coding result. However, these prior systems accomplish this result by just limiting the number of circuits in the detection zone so that the zone can only accommodate a few different tuned circuits at one time. This has the undesirable effect of effectively requiring wide spacing between tuned circuits on a tag and therefore undesirably increasing the size of the tag on which the tuned circuits are provided.

An improved RF tagging system is fully described in copending application Ser. No. 07/966,653, filed on Oct. 26, 1992, in the names of Sanjar Ghaem, Rudyard L. Istvan, and George L. Lauro, for RF Tagging System and RF Tags and Method, which application is assigned to the assignee of the present invention and fully incorporated herein by reference. The system there disclosed includes, as a significant feature, the simultaneous radiation of RF energy at a plurality of different frequencies in order to detect each of a plurality of different frequency resonant circuits which may be provided on a tag. Then a code signal indicative of which resonant frequencies for the tag resonant circuits were detected is provided. The above feature results in a much faster detection of which resonant frequency circuits are provided on a tag in a detection zone. The cross-referenced application further describes an advantageous configuration for step frequency adjusting the resonant frequencies of resonant circuits on a tag and additionally, an RF tagging system which utilizes focused narrow radiation beams for detection of individual resonant circuits on a multiple resonant frequency tag. Also, disclosed are preferred RF tag configurations/constructions and a method of making such tags. Additionally, the aforementioned cross-referenced application describes RF tagging system features related to the use of phase shifting/polarization, object approach detection and measuring both voltage and current signals so as to provide improved RF tag detection systems.

It has been further recognized that shifts in the resonant frequencies of multiple tuned resonant circuits can be caused by RF properties of the tagged items to which the resonant frequency circuits are in close proximity. The shifts in the resonant frequencies of the resonant circuits results from contents in the tagged items interacting with the resonant circuits on the RF tag. The magnitude in which resonant frequencies are shifted is a function of two mutually independent parameters: (1) frequency dependent distortions or shifts; and/or (2) spatially dependent distortions or shifts. In the case of frequency dependent distortions or shifts, the RF characteristics of the tagged item will vary with frequency. Interaction between the tagged item and the resonant frequency circuits on the tag will be more pronounced at certain frequencies than others. In the case of spatially dependent distortions or shifts, the proximity of the resonant frequency circuits to the RF disturbing elements in the tagged item effect the degree of the frequency shifts. Some resonant circuits will be closer to disturbing elements in the item than others and will thus experience more pronounced frequency shifts than other resonant circuits which are more distant from the RF disturbing elements in the tagged item.

An improved RF tagging system having resonant frequency shift compensation is fully disclosed in copending application Ser. No. 08/011,585, filed on Feb. 1, 1993, in the names of George L. Lauro, Sanjar Ghaem, and Rudyard Istvan, for Improved RF Tagging System Having Resonant Frequency Shift Compensation, which application is also assigned to the assignee of the present invention and fully incorporated herein by reference. As disclosed in that application, the frequency dependent and/or spatial dependent components of the resonant frequency shifts are detected by determining the actual resonant frequencies of reference resonant circuits on a tag. Thereafter, the difference between the actual resonant frequencies of the reference resonant circuits and the undisturbed resonant frequencies of the reference resonant circuits is determined for each reference resonant circuit and compensation factors are provided for each data resonant circuit. Responsive to the compensation factors, the resonant frequency detector determines the resonant frequencies of the data resonant circuits for generating a code indicative of which data resonant circuits are on the tag. Hence, calibration for resonant frequency shifts is provided. A first set of reference resonant circuits may be used for detecting spatially dependent resonant frequency shifts and/or a second set of reference resonant circuits may be used for detecting the frequency dependent resonant frequency shifts.

Various different methods for decoding the RF resonant circuits contained on RF tags have been proposed in the prior art for providing an identification code. For example, binary decoding has been proposed wherein the presence or absence of a given RF resonant circuit may be detected to provide two different potential binary values. The combination of the various binary values is then decoded to produce the identification code. As another example, when the RF resonant circuits are arranged in columns on an RF tag, each column of RF resonant circuits may represent a numerical digit and be detected to provide a numerical digit value for each column. The numerical values of all digits are then combined to provide the identification code.

In the prior art, RF tag readers for detecting the RF resonant circuits and providing the identification codes have been customized to employ only a single given method of decoding and for use with RF tags having a single predefined configuration or format of RF resonant circuits. Hence, an RF tag reader for use with one class or type of RF tag cannot be used with any other type or class of RF tag. Hence, in the prior art, each different type or class of RF tag has required its own corresponding type of RF tag reader.

The foregoing situation in the prior art has been indeed unfortunate for RF tag manufacturers and RF tag users alike. RF tag manufacturers are required to have available a different type of reader for each type or class of RF tag it manufactures. From the RF tag user's perspective, it must purchase a different type of RF tag reader for each type of RF tag it uses.

In addition to the foregoing, it is important when reading an RF tag to be able to verify or confirm the detection of all resonant circuits contained on the tag. For example, if binary decoding is employed and an RF resonant circuit on the tag is not detected for some reason, this can result in the provision of an incorrect identification code. Prior art RF tagging systems have not provided for such RF resonant circuit detection verification or confirmation.

SUMMARY OF THE INVENTION

The present invention therefore provides an RF tagging system including an RF tag including a plurality of RF resonant circuits with each RF resonant circuit being resonant at a given RF frequency. The plurality of RF resonant circuits include a group of decoder RF resonant circuits having resonant frequencies defining one of a plurality of predetermined decoding modalities and a group of data RF resonant circuits having resonant frequencies corresponding to a predetermined identification code when the resonant frequencies of the data RF resonant circuits are decoded in accordance with the one decoding modality. The RF tagging system further includes an RF tag reader for detecting the resonant frequencies of the group of decoder RF resonant circuits and determining the one decoding modality. The RF tag reader further detects the resonant frequencies of the group of data RF resonant circuits, is operative in each of the plurality of predetermined decoding modalities, and decodes the resonant frequencies of the group of data RF resonant circuits in accordance with the one decoding modality to provide the identification code after detecting the resonant frequencies of the group of decoder RF resonant circuits and determining the one decoding modality.

In accordance with one aspect of the present invention, the group of data RF resonant circuits includes a predetermined number of data RF resonant circuits, the resonant frequencies of the decoder RF resonant circuits are also indicative of the predetermined number, and the RF tag reader determines the predetermined number upon detecting the resonant frequencies of the decoder RF resonant circuits to confirm the accurate detection of the data RF resonant circuits.

In accordance with a further aspect of the present invention, the RF tag further includes a group of reference RF resonant circuits. The reference RF resonant circuits are resonant at predetermined undisturbed resonant frequencies and the RF tag reader is further selectively operable in a calibration mode for detecting the actual resonant frequencies of the reference RF resonant circuits, for determining resonant frequency shifts between the predetermined undisturbed resonant frequencies and the actual resonant frequencies of the reference RF resonant circuits, and is responsive to the resonant frequency shifts for detecting the resonant frequencies of the data RF resonant circuits.

In accordance with a still further aspect of the present invention, each data RF resonant circuit has a resonant frequency within a respective different frequency band and the resonant frequencies of the decoder RF resonant circuits also identify the frequency bands of the data RF resonant circuit resonant frequencies.

The present invention further provides an RF tagging system including an RF tag including a plurality of RF resonant circuits with each RF resonant circuit being resonant at a given RF frequency. The plurality of RF resonant circuits include a predetermined number of data RF resonant circuits having resonant frequencies corresponding to a predetermined identification code and a group of decoder RF resonant circuits having resonant frequencies indicative of the predetermined number. The RF tagging system further includes an RF tag reader for detecting the resonant frequencies of the data RF resonant circuits to provide the identification code and for detecting the resonant frequencies of the decoder RF resonant circuits and determining the predetermined number to confirm the accurate detection of all the data RF resonant circuits.

The present invention still further provides an RF tagging system including an RF tag including a plurality of RF resonant circuits, each RF resonant circuit being resonant at a given RF frequency, wherein the plurality of RF resonant circuits includes a predetermined number of data RF resonant circuits having resonant frequencies corresponding to a predetermined identification code. The RF tagging system further includes an RF tag reader for detecting the resonant frequencies of the data RF resonant circuits to provide the identification code and for determining the number of detected data RF resonant circuits and comparing it to the predetermined number for confirming the accurate detection of all the data RF resonant circuits.

DESCRIPTION OF THE PREFERRED EMBODIMENTS

Figure 1:
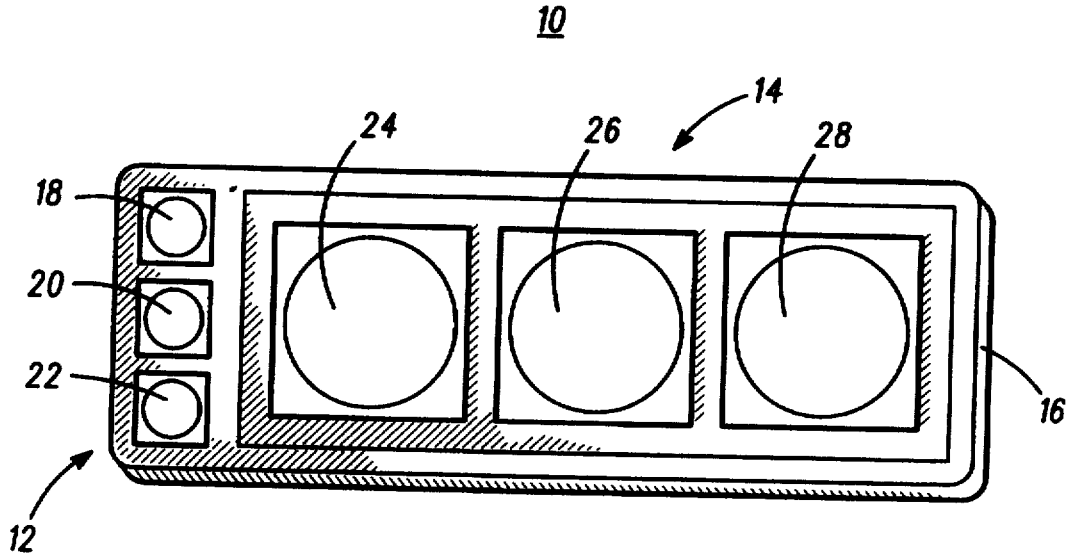
FIG. 1 is a top view of an RF tag embodying aspects of the present invention which includes a plurality of decoder resonant circuits and a plurality of data resonant circuits.

Referring now to FIG. 1, it illustrates an RF tag 10 embodying certain aspects of the present invention and which may be utilized to advantage in an RF tagging system embodying the present invention to be described hereinafter. The RF tag 10 generally includes a plurality of RF resonant circuits including a group of decoder RF resonant circuits 12 and a group of data RF resonant circuits 14. The groups of RF resonant circuits 12 and 14 are formed on a suitable insulative substrate 16 in a manner fully described in cross-referenced copending application Ser. No. 07/966,653.

The group 12 of decoder RF resonant circuits include decoder RF resonant circuits 18, 20, and 22 and the group 14 of data RF resonant circuits include data RF resonant circuits 24, 26, and 28. As will be seen hereinafter, the RF tag 10 may be utilized to advantage in the RF tagging system to be described hereinafter with respect to FIGS. 3 and 4.

Figure 3:
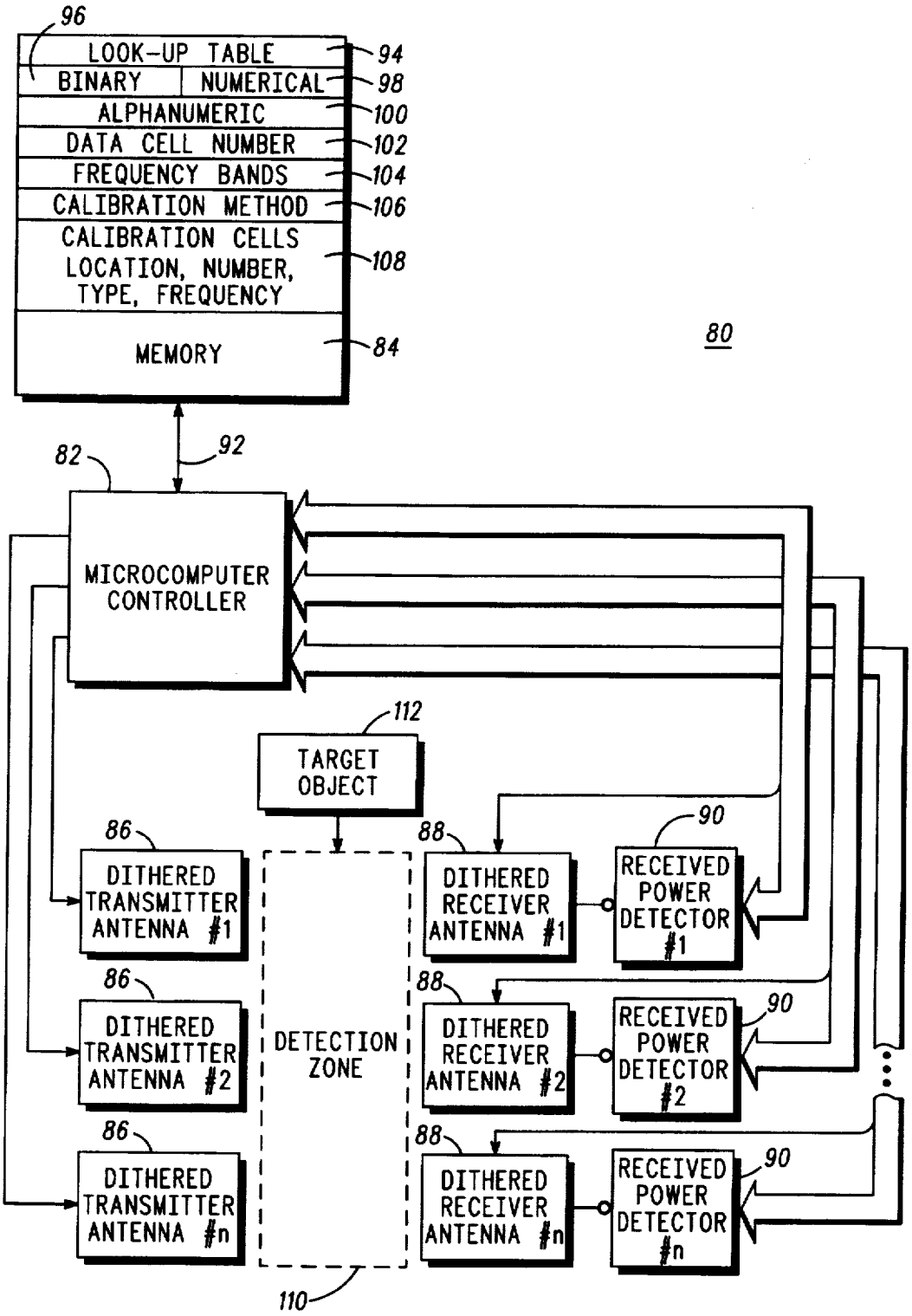
FIG. 3 is a schematic diagram of an RF tagging system constructed in accordance with the present invention.

As will be described hereinafter, the RF tag reader of FIG. 3 is operative in each of a plurality of predetermined decoding modalities and is arranged to detect the resonant frequencies of the group 14 of data RF resonant circuits and to decode the detected resonant frequencies of the group 14 of data RF resonant circuits in accordance with one of the decoding modalities to provide an identification code corresponding to the RF tag 10. More specifically, the RF tag reader of FIG. 3 is operative in either a binary decoding modality, a numerical decoding modality, or an alphanumeric decoding modality. To that end, each of the decoder RF resonant circuits 18, 20, and 22 is resonant at a given RF frequency and the resonant frequencies of the group 12 of decoder RF resonant circuits define one of the plurality of predetermined decoding modalities which should be implemented by the RF tag reader for decoding the resonant frequencies of the group 14 of data RF resonant circuits to provide the identification code for the tag 10.

With respect to the RF tag 10 of FIG. 1, and in accordance with this preferred embodiment, the resonant frequencies of the group 12 of decoder RF resonant circuits will define the numerical decoding modality of the RF tag reader of FIG. 3. To that end, each of the data RF resonant circuits 24, 26, and 28 is resonant at one frequency of ten possible different frequencies within a respective different frequency band. Hence, the resonant frequency of each data RF resonant circuit 24, 26, and 28 corresponds to one numerical digit of a three-digit number.

To permit the RF tag reader to successfully detect the resonant frequency of each of the data RF resonant circuits 24, 26, and 28, the resonant frequencies of the decoder RF resonant circuits 18, 20, and 22 further define the frequency bands corresponding to each of the data RF resonant circuits 24, 26, and 28. In addition, the resonant frequencies of the decoder RF resonant circuits 18, 20, and 22 further define the number of data RF resonant circuits contained on the RF tag 10. This permits the RF tag reader to confirm the accurate detection of the resonant frequencies of the data RF resonant circuits 24, 26, and 28 in a manner to be described hereinafter.

Hence, as can be understood from the foregoing, when the RF tag 10 enters a detection zone of the RF tag reader, the RF tag reader first detects the resonant frequencies of the decoder RF resonant circuits 18, 20, and 22 to determine the number of data RF resonant circuits contained on tag 10, the frequency bands which the RF tag reader must sweep to detect the resonant frequencies of the data RF resonant circuits 24, 26, and 28, and the decoding modality which the RF tag reader must implement for decoding the resonant frequencies of the data RF resonant circuits for providing the identification code of the tag 10. As previously mentioned, for the RF tag 10, the resonant frequencies of the decoder RF resonant circuits 18, 20, and 22 will define and cause the RF tag reader to implement the numerical decoding modality.

Figure 2:
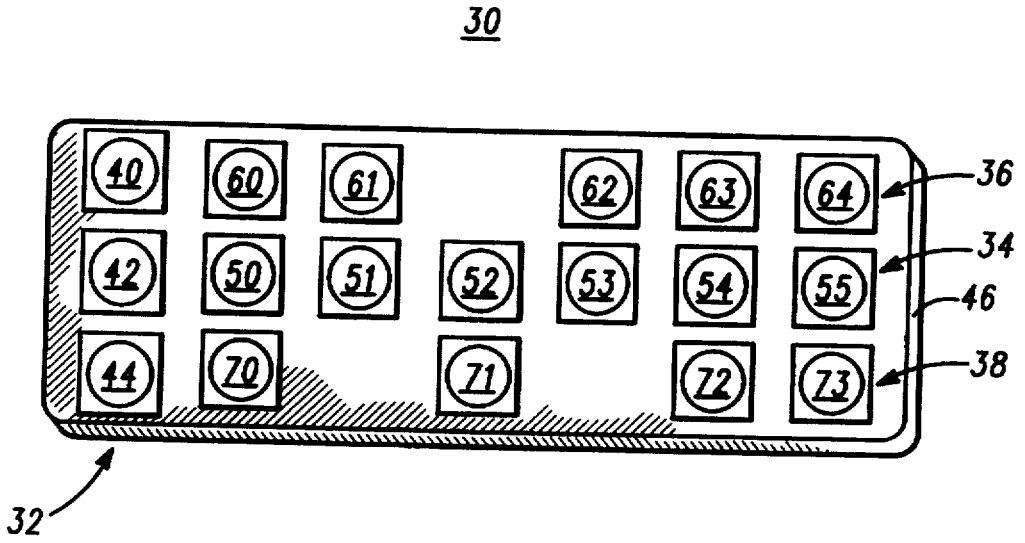
FIG. 2 is a top view of an RF tag embodying further aspects of the present invention which includes a plurality of decoder resonant circuits, a plurality of data resonant circuits, a plurality of spatial reference resonant circuits, and a plurality of frequency reference resonant circuits.

Referring now to FIG. 2, it illustrates another RF tag 30 which embodies further aspects of the present invention and which may be utilized to advantage in practicing the present invention. Prior to describing the RF tag 30, it may be mentioned that the RF tag reader of FIG. 3 is selectively operable in a calibration modality to compensate for shifts in the resonant frequencies of data RF resonant circuits due to the interaction between the data RF resonant circuits and the contents of the tagged items. Two different calibration methodologies are contemplated by the present invention and are fully described in the aforementioned cross-referenced copending application Ser. No. 08/011,585. One calibration methodology is to compensate for frequency dependent shifts in resonant frequency and the other calibration methodology is to compensate for spatially dependent shifts in resonant frequency. In the case of frequency dependent shifts, the RF characteristics of the tagged item will vary with frequency. Interaction between the tagged item and the resonant frequency circuits on the tag will be more pronounced at certain frequencies than others. In the case of spatially dependent shifts, the proximity of the resonant frequency circuits to the RF disturbing elements in the tagged item effect the degree of the frequency shifts. Some resonant circuits will be closer to disturbing elements in the item than others and will thus experience more pronounced frequency shifts than other resonant circuits which are more distant from the RF disturbing elements in the tagged item.

In view of the foregoing, the RF tag 30 generally includes a first group 32 of decoder RF resonant circuits, a second group 34 of data RF resonant circuits, a third group 36 of spatial reference RF resonant circuits, and a fourth group 38 of frequency reference RF resonant circuits. More specifically, the first group 32 of decoder RF resonant circuits include resonant circuits 40, 42, and 44. The second group 34 of data RF resonant circuits include data RF resonant circuits 50–55. The third group 36 of spatial reference RF resonant circuits include spatial reference resonant circuits 60–64. Lastly, the fourth group 38 of frequency reference RF resonant circuits include frequency reference RF resonant circuits 70–73. Again, all of the RF resonant circuits contained on tag 30 may be formed on a suitable insulative substrate 46 in a manner fully described in the aforementioned copending cross-referenced application Ser. No. 07/966,653.

In accordance with this preferred embodiment, the data RF resonant circuits 50–55 are adequate in number so that their resonant frequencies may be decoded for providing the identification code for tag 30 through either the binary decoding modality or the alphanumeric decoding modality. In accordance with the binary decoding modality, the presence or absence of a data RF resonant circuit will provide one of two possible binary levels. As a result, since there are six data RF resonant circuits on tag 46, tag 46 is capable of yielding a six-digit binary number when the resonant frequencies of the data RF resonant circuits 50–55 are decoded in accordance with the binary modality.

In accordance with the alphanumeric binary modality, each of the data RF resonant circuits 50–55 is resonant at one of six different possible resonant frequencies within a respective given different resonant frequency band. As a result, the RF tag 30 is capable of providing a six digit alphanumeric number for its identification code when the resonant frequencies of the data RF resonant circuits 50–55 are decoded in accordance with the alphanumeric decoding modality.

In view of the foregoing, it can be appreciated that the resonant frequencies of the decoder RF resonant circuits 40, 42, and 44 define the number of data RF resonant circuits contained on the RF tag 30, the frequency bands at which the data RF resonant circuits resonate, the presence, number, type (spatial and/or frequency) and resonant frequencies of the calibration reference RF resonant circuits, the decoding modality to be implemented by the RF tag reader for providing the identification code of the RF tag 30, and the calibration method (spatial and/or frequency) to be used for compensating for the interaction between the data RF resonant circuits and the contents of the tagged item. As will be seen hereinafter, the RF tag reader includes a look-up table for providing this information responsive to he combination of detected resonant frequencies of the decoder RF resonant circuits 40, 42, and 44.

Referring now to FIG. 3, it illustrates in schematic diagram form, an RF tag reader 80 embodying the present invention. The RF tag reader 80 generally includes a microprocessor controller 82, a memory 84, a plurality of dithered or variable frequency transmitters 86, a like plurality of dithered or variable frequency receivers 88, and a like plurality of received power detectors 90.

The microprocessor controller 82 controls the overall operation of the RF tag reader 80. The microprocessor controller 82 is coupled to the memory 24 by a bidirectional bus 92 for receiving operating instructions from the memory 84 and required data to permit the microprocessor controller 82 to control the detection of the resonant frequencies of the RF resonant circuits contained on an RF tag and for decoding the RF resonant frequencies of the data RF resonant circuits in the decoding modality defined by the decoder RF resonant circuits on a tag to the ultimate end of providing the identification code of an RF tag. To that end, the memory 84 includes a look-up table portion 94 which includes a plurality of entries with each entry corresponding to one possible combination of decoder RF resonant frequencies and a corresponding entry of the information required by the microprocessor controller 82 for controlling the operation of the RF tag reader 80. More specifically, the memory 84 provides the microprocessor controller 82 with binary decoding instructions from a memory portion 96 when binary decoding is required, numerical decoding instructions from a memory portion 98 when numerical decoding is required, and alphanumeric decoding instructions from a portion 100 when alphanumeric decoding is required. In addition, the memory 84 provides the microprocessor controller 82 with the number of data RF resonant circuits contained on the RF tag from a portion 102 and the frequency bands of the resonant frequencies of the data RF resonant circuits from another portion 104. Lastly, the memory 84 provides calibration instructions from another portion 106 which include calibration instructions for spatial dependent resonant frequency shifts and/or frequency dependent resonant frequency shifts and from a portion 108, the location, number, type, and undisturbed resonant frequencies of the reference resonant circuits contained on the tag. As will be appreciated by those skilled in the art, all such information is prestored within the memory 84.

The microprocessor controller 82 is also coupled to the dithered transmitters 86 which are numbered 1 through n. In accordance with this preferred embodiment, there is a dithered transmitter 86 provided for each resonant circuit which may reside on an RF tag. As will be seen hereinafter, each of the dithered transmitters 86 radiates radio frequency energy in a frequency range which sweeps a frequency range defined by the decoder RF resonant circuits contained on the RF tags. In the calibration modality, the dithered transmitters 26 preferably sweep their frequency ranges above and below a center frequency corresponding to estimated actual resonant frequencies of the reference resonant circuits as fully described in the copending cross-referenced application Ser. No. 08/011,585.

Similarly, each of the dithered receivers 88 are numbered from 1 through n and are coupled to the microprocessor controller 82. Each of the dithered receivers 88, under control of the microprocessor controller 82, receives radio frequency energy in the frequency range of the radio frequency energy transmitted by its correspondingly numbered dithered transmitter.

The received power detectors 90 are similarly numbered 1 through n and provide for the detection of received power from its corresponding dithered receiver 88. The received power detectors 90 are also coupled to the microprocessor controller 82 for providing the microprocessor controller 82 with received power data. This permits the microprocessor controller 82 to determine which resonant circuits are contained on an RF tag.

The dithered transmitters 86 and dithered receivers 88 define a detection zone 110 which the target object 112 (an RF tag) enters when the identification code on the RF tag is to be provided. The presence of the target object 112 within the detection zone 110 may be detected in a manner as disclosed in the aforementioned copending cross-referenced application Ser. No. 07/966,653.

The presence of a resonant circuit on the target object 112, and thus within the detection zone 110, may be detected in a number of different ways in accordance with the present invention. For example, the presence of a resonant circuit may be detected by the amount of loading that the resonant circuit places on its corresponding dithered transmitter 86. This manner of detection is a form of grid dip detection which is fully described in the aforementioned cross-referenced application Ser. No. 07/966,653.

The presence of a resonant circuit within the detection zone 110 may also be detected by detecting the ringing of a resonant circuit immediately after its corresponding dithered transmitter 86 is turned off. The ringing radio frequency energy emitted from the resonant circuit may be detected by its corresponding dithered receiver 88 and the power of the received energy may then be detected by the corresponding received power detector 90. The corresponding received power detector 90 then conveys information to the microprocessor controller 82 indicating that a ringing signal was received from the corresponding resonant circuit. This method of detection is also fully described in the aforementioned cross-referenced application Ser. No. 07/966,653.

The presence of a resonant circuit within the detection zone 110 may further be detected in accordance with the present invention by detecting absorption of the radiated radio frequency energy provided by its corresponding dithered transmitter 86. As the dithered transmitter 86 transmits, the corresponding dithered receiver receives radio frequency energy which, in the presence of the corresponding resonant circuit within detection zone 110, will be of less power than transmitted by the corresponding dithered transmitter 86. The corresponding received power detector 90 then conveys the received power to the microprocessor controller 82 which then determines if there has been power absorption of the radio frequency energy radiated by the corresponding dithered transmitter 86. This method of detection is also fully disclosed in the aforementioned cross-referenced application Ser. No. 07/966,653.

Figure 4:
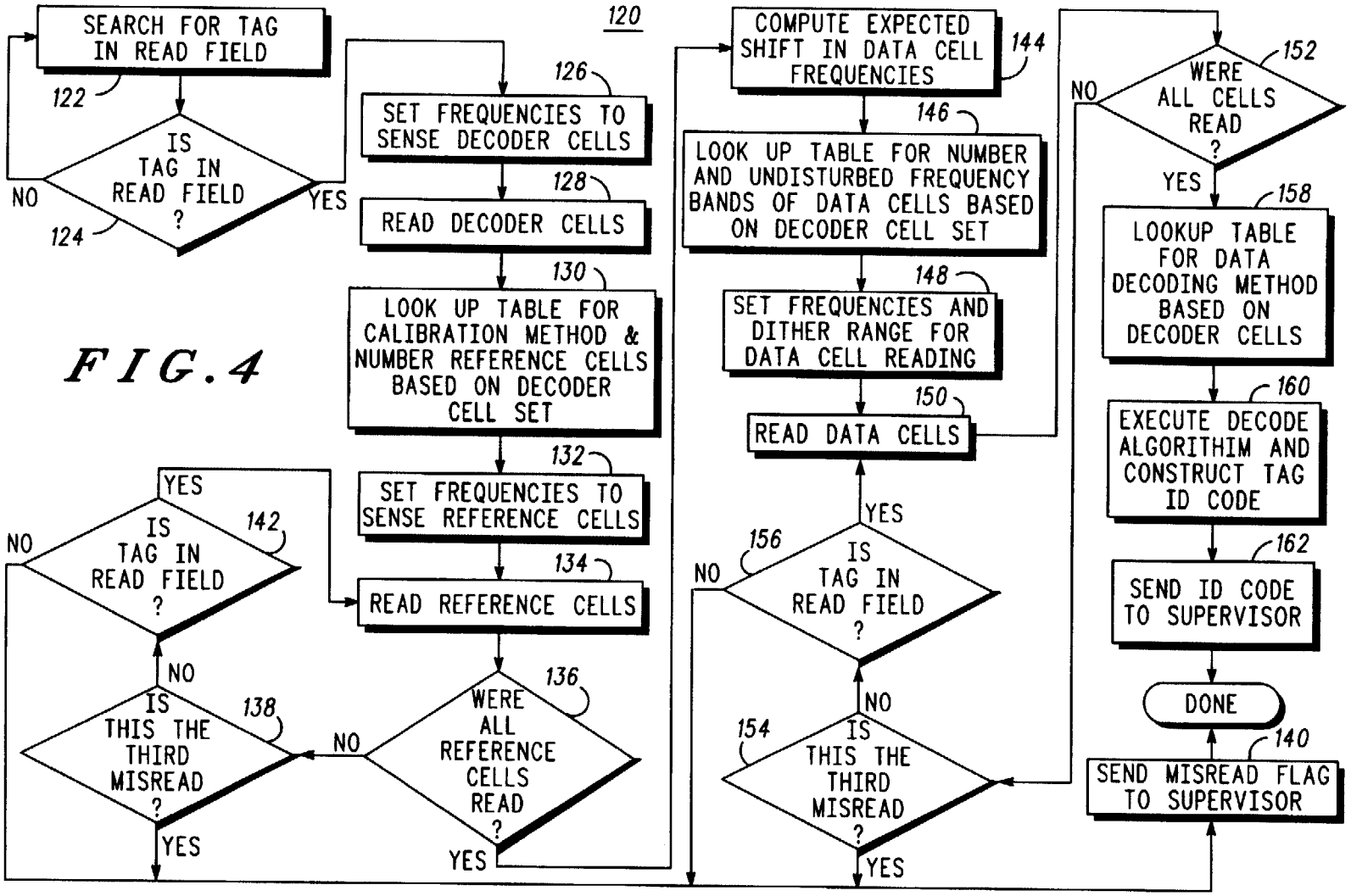
FIG. 4 is a flow chart illustrating the manner in which the system of FIG. 3 may be implemented in accordance with a preferred embodiment of the present invention.

Referring now to FIG. 4, it is a flow chart 120 illustrating the overall operation of an RF tagging system including the RF tag 30 of FIG. 2 and the RF tag reader 80 of FIG. 3 in accordance with a preferred embodiment of the present invention. As will be noted hereinafter, the flow chart 120 includes the steps of performing the aforementioned calibration for compensating for spatial dependent and/or frequency dependent resonant frequency shifts due to interaction between the RF tag 30 and the tagged item. It is to be understood that the calibration steps may be omitted if an RF tag such as RF tag 10 of FIG. 1 is to be decoded since the RF tag 10 does not include either spatial or frequency reference RF resonant circuits. Those steps which may be eliminated from the flow chart 120 for decoding an RF tag such as RF tag 10 will be identified herein.

The operation of the system begins with step 122 wherein the RF tag reader 80 continually searches for an RF tag in the read field or detection zone 110. Periodically, the microprocessor 82 in accordance with step 124 determines if an RF tag is within the detection zone 110. If an RF tag is not within the detection zone 110, the process returns to step 122. If however an RF tag is within the detection zone 110, the process then proceeds to step 126 wherein the frequencies of the dithered transmitters 86 and dithered receivers 88 are set for detecting the resonant frequencies of the decoder RF resonant circuits 40, 42, and 44 of tag 30. Once the frequencies of the dithered transmitters 86 and dithered receivers 88 are set, the process proceeds to step 128 wherein the resonant frequencies of the decoder RF resonant cells 40, 42, and 44 are detected.

After the resonant frequencies of the decoder RF resonant circuits 40, 42, and 44 are detected, the microprocessor controller 82 then utilizes the look-up table of the memory 84 to determine which calibration method should be used, and the location, number, and type of reference resonant circuits contained on the RF tag 30 in accordance with step 130. Also in step 130, the microprocessor controller 82 determines from the look-up table of memory 84 the frequency bands of the reference resonant circuits contained on the RF tag 30.

The process then continues to step 132 wherein the frequencies of the dithered transmitters 86 and dithered receivers 88 are set to detect the actual resonant frequencies of the reference RF resonant circuits. In the next step 134, the RF tag reader 80 detects the actual resonant frequencies of the reference RF resonant circuits. Next, in step 136, the microprocessor controller 82 determines if all of the resonant frequencies of the reference resonant circuits were detected. In performing step 136, the microprocessor controller 182 compares the number of resonant frequencies detected to the number of reference resonant circuits which are contained on the RF tag 30, which number was previously provided from the memory 84 from its look-up table. Alternatively, if the RF tag reader 80 is of the type wherein the resonant circuits of the RF tag are closely aligned with the dithered transmitters 86 and dithered receivers 88, the microprocessor may compare the number of reference resonant circuits detected to the number of reference resonant circuits expected to be contained on the RF tag.

If not all of the reference resonant circuits were detected, the process then proceeds to step 138 wherein the microprocessor controller 82 determines if the last detection was the third misdetection. If it was, the RF tag reader 80 generates an error code in step 140. However, if the last detection was not the third misdetection, the process then proceeds to step 142 to determine if the RF tag is within the detection zone 110. If the RF tag is not within the detection zone, the RF tag reader generates the error code in accordance with 140. However, if the RF tag is within the detection zone 110, the process then returns back to step 134 to once again detect the resonant frequencies of the reference RF resonant circuits.

When all of the resonant frequencies of the reference resonant circuits are detected, the process then proceeds to step 144 to determine the expected shift in the resonant frequencies of the data RF resonant circuits 50–55. Step 144 may be accomplished as fully described in the copending cross-referenced application Ser. No. 08/011,585.

The system then proceeds to step 146 wherein the look-up table is accessed for the number of data RF resonant circuits contained on the RF tag and the undisturbed resonant frequency bands of the data RF resonant circuits corresponding to the resonant frequencies of the decoder RF resonant circuits. After step 146, the process proceeds to step 148 wherein the frequencies and dither range of the dithered transmitters 86 and dithered receivers 88 are set for the data RF resonant circuits 50–55. Next, in step 150, the resonant frequencies of the data RF resonant circuits are detected.

After detection, in step 152, the microprocessor controller 82 determines if all of the resonant frequencies of the data RF resonant circuits were detected. In performing step 152, the microprocessor controller 82 compares the number of resonant frequencies detected to the predetermined number of data RF resonant circuits expected to be contained on the RF tag. Alternatively, if the RF tag reader 80 is of the type wherein the resonant circuits are aligned with and closely spaced from the dithered transmitters 86 and dithered receivers 88, the microprocessor controller 82 may compare the number of data RF resonant circuits detected to the predetermined number of data RF resonant circuits expected to be contained on the RF tag.

If, in performing step 152, it is determined that not all of the data RF resonant circuits were detected, the microprocessor controller 82 then in step 154 determines if the last detection was the third misdetection. If it was, the RF tag reader 80 generates the error code in accordance with step 140. If it was not the third misdetection, the process then continues to step 156 wherein it is determined if the RF tag is still within the detection zone 110. If the RF tag is not within the detection zone, the RF tag reader 80 then proceeds to step 140 and generates the error code. If, however, it is determined that the RF tag is within the detection zone 110, the RF tag reader 80 returns to step 150 to once again detect the resonant frequencies of the data RF resonant circuits 50–55.

When all of the data RF resonant circuits have been detected, that is, when there has been accurate detection of all of the resonant frequencies of the data RF resonant circuits, the microprocessor controller 82 then proceeds to step 158 to obtain from the memory 84 the decoding modality to be utilized for decoding the resonant frequencies of the data RF resonant circuits of the RF tag 30. Once the decoding modality is determined, the microprocessor controller 82 proceeds to step 160 and is operative in the decoding modality defined by the resonant frequencies of the decoder RF resonant circuits 40, 42, and 44 for decoding the resonant frequencies of the data RF resonant circuits in accordance with the defined decoding modality to construct the identification code of the RF tag 30.

Once the identification code of the RF tag 30 is constructed, the RF tag reader 80 then proceeds to step 162 to provide the identification code of the RF tag 30. It will be noted from the flow chart 120 that after either step 140 or step 162, the RF tag reader has completed the processing of the RF tag to return to step 122 to continue to search for another RF tag in the detection zone 110.

As previously mentioned, the flow chart 120 includes the steps required for implementing the calibration modality. If an RF tag enters the detection zone 110 which includes decoder RF resonant circuits having resonant frequencies which do not require the calibration mode, such as for example RF tag 10 of FIG. 1, the RF tag reader 80 will not be rendered operative in the calibration mode. As a result, after completing step 130 which would reveal from the look-up table that the calibration modality is not required, the processor would then continue to step 146 to determine the number and undisturbed frequency bands of the data RF resonant circuits based upon the resonant frequencies of the decoder RF resonant circuits. The process would then continue until completion as indicated in the flow chart 120.

As can be seen from the foregoing, the present invention provides an RF tagging system having the capability of adjusting its operating modalities based upon information received from the decoder RF resonant circuits of the RF tag to enable the RF tag reader to be used to detect a variety of classes of RF tags wherein each class of RF tag is decoded in accordance with a different decoding modality. With such an improved RF tagging system, a universal RF tag reader of fixed configuration can be manufactured in a high volume, efficient production line. The RF tags for various RF tag users can be encoded using methods that are uniquely suited to their needs. For example, RF tag users requiring rather simple identification of a small number of objects could employ RF tags that operate or resonate in narrow frequency bands. The decoding modality required for such RF tag users could be implemented in accordance with a simple and a fast-executing algorithm of the RF tag reader. Other RF tag users may require a more complicated encoding scheme such as alphanumeric encoding of the RF tag data RF resonant circuits. Such systems would require wide frequency bands and more sophisticated decoding modalities.

Unlike disposable RF tags where very high volumes may be purchased by each RF tag user, volumes of RF tag readers must be accumulated across several RF tag users to achieve a scale sufficient to realize appreciable economies. The RF tagging system of the present invention permits such RF tag reader accumulation for realizing appreciable economies.

In addition to the foregoing, by virtue of the decoder RF resonant circuits, the RF tagging system provides a wide latitude in the types of RF tags which may be utilized. This is due to the fact that the number of resonant circuits, frequency bands, decoding modalities, and calibration methods need not be fixed across an entire RF tag population. Rather, variations in these parameters may be accommodated by the RF tagging system of the present invention.

By virtue of the present invention, confirmation that all of the resonant circuits on an RF tag is made possible by comparing the number of resonant circuits detected to a pre-defined number defined by the resonant frequencies of the decoder RF resonant circuits. Such vital confirmation is obtained at virtually no additional expense to the RF tag user.

While particular embodiments of the present invention have been shown and described, modifications may be made. For example, in RF tagging systems wherein the number of data RF resonant circuits on the tags is known, it would not be necessary to provide the decoder resonant circuits indicative of that number. Instead, the predetermined number of data RF resonant circuits may be stored in memory 84 of FIG. 3 and utilized for comparing it to the number of data RF resonant circuits detected. It is therefore intended to cover in the appended claims all such changes and modifications which fall within the true spirit and scope of the invention.

What is claimed is:

1. An RF tagging system comprising:

an RF tag including a plurality of RF resonant circuits, each said RF resonant circuits being resonant at a given RF frequency, said plurality of RF resonant circuits including a predetermined number of data RF resonant circuits having resonant frequencies, in various frequency bands, corresponding to a predetermined identification code and a group of decoder RF resonant circuits having resonant frequencies indicative of said various frequency bands; and an RF tag reader for detecting the resonant frequencies of said data RF resonant circuits to provide said identification code and for detecting the resonant frequencies of said decoder RF resonant circuits and determining said various frequency bands, and altering reader frequency detection operation in accordance with the determined frequency bands, in accordance with said detected decoder resonant frequencies for accurate detection of all said data RF resonant circuits.

* * * * *